United States Patent [19]

Fukuo et al.

[11] Patent Number: 4,753,201

[45] Date of Patent: Jun. 28, 1988

[54] CRANKSHAFT SUPPORTING STRUCTURE FOR MULTICYLINDER INTERNAL COMBUSTION ENGINES

[75] Inventors: Koichi Fukuo; Masatoshi Chosa; Akio Kazama; Nobuo Anno; Yukio Kusakabe, all of Saitama, Japan

[73] Assignee: Honda Giken Kogyo Kabushiki Kaisha, Tokyo, Japan

[21] Appl. No.: 802,773

[22] Filed: Nov. 27, 1985

[30] Foreign Application Priority Data

Dec. 6, 1984 [JP] Japan ..... 59-258151
Jun. 3, 1985 [JP] Japan ..... 60-83813[U]

[51] Int. Cl.[4] ..... F02F 7/00; F01M 1/00

[52] U.S. Cl. ..... 123/195 R; 123/195 C; 123/196 R

[58] Field of Search ..... 123/195 R, 195 H, 195 C, 123/195 S, 196 R; 124/6.5–6.9

[56] References Cited

U.S. PATENT DOCUMENTS 3,304,134 2/1967 Allen ..... 123/195 R
4,467,755 8/1984 Hayashi ..... 123/195 H
4,622,933 11/1986 Fukuo et al. ..... 123/196 R

FOREIGN PATENT DOCUMENTS 1328196 8/1973 United Kingdom ..... 123/195 H

*Primary Examiner*—Craig R. Feinberg
*Attorney, Agent, or Firm*—Lyon & Lyon

[57] ABSTRACT

A crankshaft supporting structure in a multicylinder internal combustion engine has a cylinder block made of a light alloy and including a cylinder housing and a crankcase having a plurality of spaced journal walls. A plurality of spaced bearing caps made of an iron alloy are coupled respectively to the journal walls. A crankshaft is rotatably supported in bearing holes defined by the journal walls and the bearing caps. A bridge made of a light alloy extends across the bearing caps and is coupled to the bearing caps. The bearing caps and the bridge are fastened together to the journal walls by connecting bolts disposed one on each side of the crankshaft. The bridge has a main portion defining a main gallery extending longitudinally therethrough and a plurality of legs coupled to the bearing caps, respectively. The bearing caps and the legs jointly define branch oil passages communicating with the main gallery and the bearing holes. In one embodiment, each of the oil passages has a longitudinal central axis displaced transversely from the central axis of the cylinder housing passing through the center of the crankshaft.

14 Claims, 7 Drawing Sheets

CRANKSHAFT SUPPORTING STRUCTURE FOR MULTICYLINDER INTERNAL COMBUSTION ENGINES

BACKGROUND OF THE INVENTION

The present invention relates to a crankshaft supporting structure for in-line and V-shaped multicylinder internal combustion engines.

There is known a multicylinder internal combustion engine in which the crankshaft is rotatably supported by a plurality of journal walls integrally formed with the crankcase of the cylinder block and a plurality of bearing caps secured to the journal walls by bolts. The bearing caps are reinforced by a bridge to increase the rigidity of the crankshaft bearing assembly (see U.S. Pat. No. 3,841,203).

According to another known multicylinder internal combustion engine, a plurality of bearing caps supporting a crankshaft are secured respectively to a plurality of journal walls of the cylinder block, and the bearing caps are interconnected by a bridge. The crankshaft is supplied with lubricating oil from a lubricating oil system defined in the bearing caps and the bridge (see U.S. Pat. No. 1,759,147).

With the conventional multicylinder internal combustion engines, the rigidity of the crankshaft bearing assembly is of high rigidity since the bearing caps are interconnected by the bridge. The crankshaft bearing assembly is however disadvantageous in that the overall weight of the engine is increased.

SUMMARY OF THE INVENTION

It is an object of the present invention to provide a crankshaft supporting structure for multicylinder internal combustion engines which comprises journal walls, bearing caps, and a bridge for supporting a crankshaft and includes a crankshaft bearing assembly of high rigidity for increased crankshaft supporting strength while reducing the overall engine weight.

Another object of the present invention is to provide a crankshaft supporting structure for multicylinder internal combustion engines which comprises journal walls of a light alloy, bearing caps of an iron alloy, and a bridge of a light alloy, the bearing caps being subject to a reduced degree of axial thermal strain because they are firmly fastened between the journal walls and the bridge.

Still another object of the present invention is to provide a crankshaft supporting structure for multicylinder internal combustion engines which comprises journal walls, bearing caps, and a bridge for supporting a crankshaft, the bridge being made of an aluminum alloy for reducing the weight of the crankshaft supporting structure and being constructed to provide higher rigidity even with a lubricating oil system incorporated in the bearing caps and the bridge.

According to the present invention, there is provided a crankshaft supporting structure in a multicylinder internal combustion engine, comprising a cylinder block made of a light alloy and including a cylinder housing defining a plurality of cylinder bores and a crankcase having a plurality of spaced journal walls, a plurality of spaced bearing caps made of an iron alloy coupled respectively to the journal walls, the journal walls and the bearing caps jointly defining bearing holes therebetween, a crankshaft rotatably supported in the bearing holes, and a bridge made of a light alloy and extending across the bearing caps and coupled to the bearing caps. The bridge includes a central main portion extending across the bearing caps along the crankshaft and a plurality of legs integral with the main portion and held against the bearing caps, respectively. The bridge also includes a pair of spaced outer portions extending parallel to the main portion across the outer ends of the legs and interconnecting the legs. Therefore, the bridge is of a grid-like configuration. The main portion defines a main gallery extending longitudinally therethrough, the legs and the bearing caps defining a plurality of branch oil passages therethrough, the branch oil passages communicating with the main gallery and the bearing holes. In one embodiment of the invention, each of the branch oil passages has a longitudinal central axis displaced transversely to one side from the central axis of the cylinder housing passing through the center of the crankshaft and the main gallery has a longitudinal central axis displaced transversely to said one side from the central axis of the cylinder housing.

The above and other objects, features and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 1:
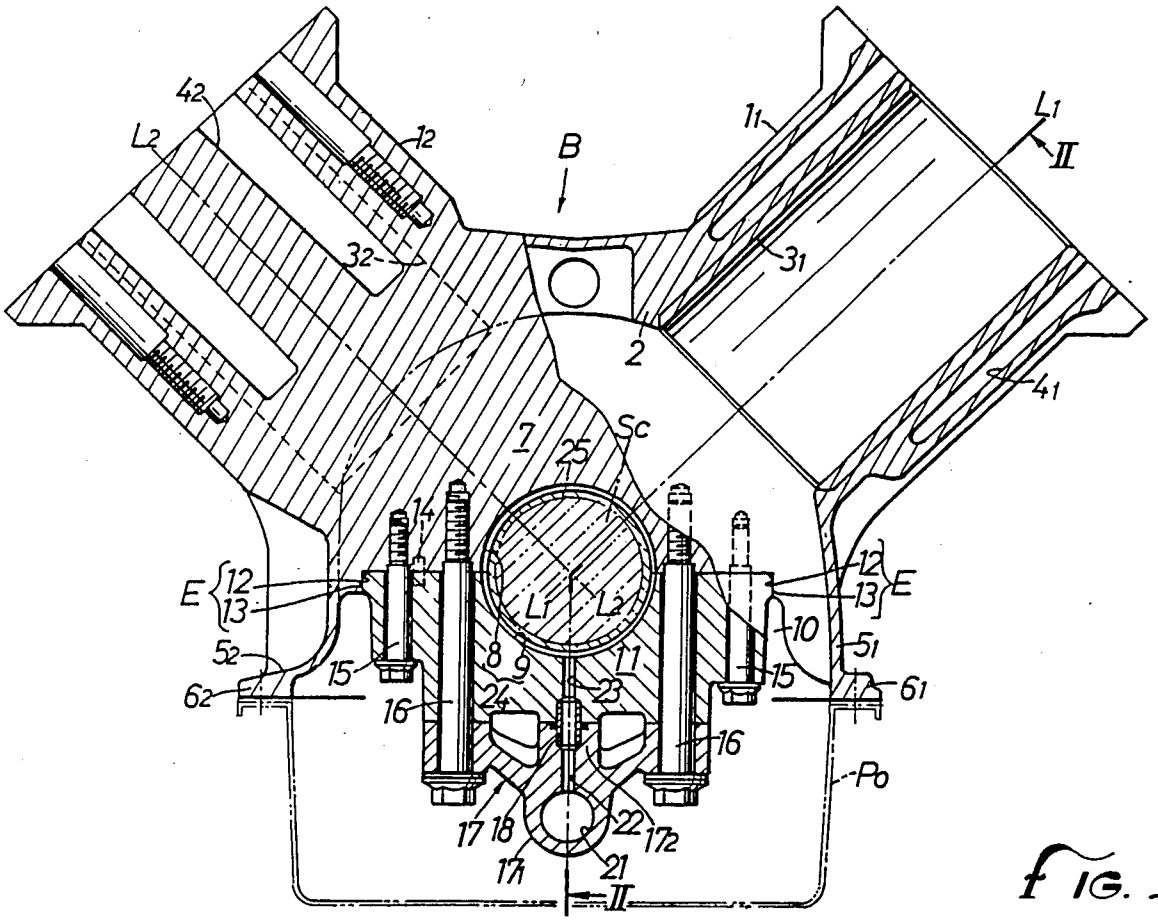
FIG. 1 is a vertical cross-sectional view of a crankshaft supporting structure according to an embodiment of the present invention.
Figure 2:
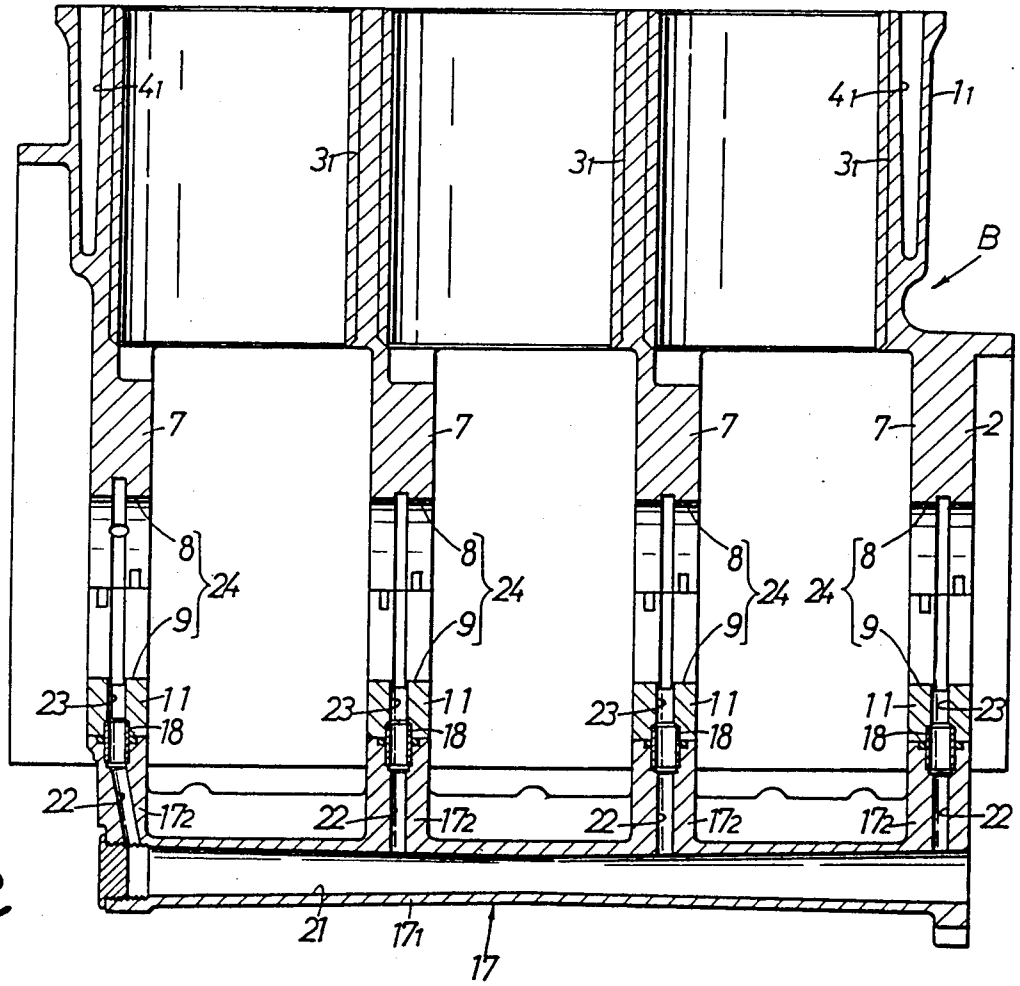
FIG. 2 is a cross-sectional view taken along line II—II of FIG. 1.

A crankshaft supporting structure according to an embodiment shown in FIGS. 1 and 2 is incorporated in a V6 internal combustion engine.

The internal combustion engine has a cylinder block B comprising two cylinder housings $\mathbf{1}_1$; $\mathbf{1}_2$ arranged in a V shape and a crankcase 2 integrally connecting the lower coupled portions of the cylinder housings $\mathbf{1}_1$, $\mathbf{1}_2$. The cylinder housings $\mathbf{1}_1$; $\mathbf{1}_2$ have inclined cylinder axes $L_1$-$L_2$-$L_2$, respectively, and three in-line cylinder bores $\mathbf{3}_1$, $\mathbf{3}_2$, respectively. The cylinder housings $\mathbf{1}_1$, $\mathbf{1}_2$, also have water jackets $\mathbf{4}_1$, $\mathbf{4}_2$ defined in the respective walls thereof in surrounding relation to the cylinder bores $3_1$, $3_2$.

The crankcase 2 has a pair of integral downwardly extending skirt walls $5_1$, $5_2$ confronting each other and extending along a crankshaft Sc. The skirt walls $5_1$, $5_2$ have integral attachment flanges $6_1$, $6_2$ on their lower ends, respectively, to which an oil pan Po is secured.

The crankcase 2 also includes four integral journal walls 7 spaced at intervals along the crankshaft Sc and extending to the skirt walls $5_1$, $5_2$.

The crankcase 2 has a downwardly opening channel-shaped recess 10 defined in the lower central portion of each of the journal walls 7 for receiving a bearing cap 11 (described later) therein. The journal walls 7 also have semicircular bearing halves 8 defined therein above the center of the recesses 10 for supporting the crankshaft Sc. Female mating surfaces 12, 12 are defined on inner opposite sides of the upper portion of the recess 10.

Bearing caps 11 of an iron alloy having a rectangular cross section are fitted respectively in the recesses 10 of the journal walls 7. Each of the bearing caps 11 has a flat upper surface held against the lower surface of one of the journal walls 7 and a semicircular bearing half 9 defined centrally in the flat upper surface thereof in registry with one of the bearing halves 8. Each bearing cap 11 has male mating surfaces 13, 13 defined on outer opposite sides of the upper portion thereof which extend along the crankshaft Sc. The female and male mating surfaces 12, 13 mate closely with each other in providing closely fit portions E. The closely fitting portions E serve to position the bearing caps 11 in a direction normal to the crankshaft Sc. Knock pins 14 are inserted in the journal walls 7 and the bearing caps 11 across their joined surfaces to position the bearing caps 11 axially with respect to the journal walls 7.

Each bearing cap 11 is secured to the corresponding journal wall 7 by a pair of first connecting bolts 15, 15 extending upwardly through laterally opposite portions thereof and threaded into the journal wall 7.

A bridge 17 made of a light alloy such as an aluminum alloy extends across and is fixed to the lower surfaces of the bearing caps 11. More specifically, the bridge 17 and the bearing cap 11 are fastened to the corresponding journal wall 7 by a pair of second connecting bolts 16, 16 longer than the first connecting bolts 15, 15 and extending upwardly through the bridge 17 at laterally opposite sides thereof and the bearing cap 11 and threaded into the journal wall 7. The bearing cap 11 and the corresponding journal wall 7 are relatively positioned by a knock pin 18 inserted therein across their joined surfaces and defining a lubricating oil passage.

The bridge 17 is composed of a main portion $17_1$ extending along the crankshaft Sc and a plurality of legs $17_2$ integrally projecting upwardly from the main portion $17_1$ toward the bearing caps 11, respectively.

The bridge 17 has a main gallery 21 defined longitudinally through the main portion $17_1$, and a plurality of branch oil passages 22 defined respectively in the legs $17_2$ and branched upwardly from the main gallery 21. The branch oil passages 22 communicate through the oil passages in the knock pins 18 with oil passages 23, respectively, defined in the bearing caps 11. The oil passages 23 open at the bearing surfaces of the bearing halves 9, respectively.

The bearing halves 8, 9 in the journal walls 7 and the bearing caps 11 jointly define a plurality of bearing holes 24 in which journal portions of the crankshaft Sc are rotatably supported by sleeve bearings 25.

Operation of the crankshaft supporting structure according to the above embodiment will be described below.

When the internal combustion engine employing the cylinder block B is operated, the explosion pressure acting on the pistons in the cylinder bores $3_1$, $3_2$ is imposed on the crankshaft Sc along the inclined cylinder axes $L_1$- $L_1$, $L_2$-$L_2$ of the cylinder housings $1_1$, $1_2$. The crankshaft Sc is therefore subject to bending and twisting forces in vertical and horizontal directions. However, the bearing assembly for the crankhsaft Sc is highly rigid and can support the crankshaft Sc highly securely since the bearing caps 11 are made of an iron alloy and are firmly secured to the journal walls 7 by the first connecting bolts 15, 15, and the bearing caps 11 and the bridge 17 are firmly secured to the journal walls 7 by the second connecting bolts 16, 16. Therefore, undesired deforming stresses acting on the crankshaft Sc are reduced.

During operation of the engine, the crankshaft Sc is subject to strong downward impacts caused by reciprocating movement of the pistons in the cylinder bores $3_1$, $3_2$. Since the bearing caps 11 are made of an iron alloy for increased rigidity, however, the downward stresses imposed on the crankshaft Sc can sufficiently be borne by the bearing caps. At the same time, the journal walls 7, the bearing caps 11, and the bridge 17 are heated to high temperatures and subject to thermal expansion. Inasmuch as the journal walls 7 and the bridge 17 are made of an alluminum alloy, their coefficients of thermal expansion are the same. With the bearing caps 11 of an iron alloy being firmly fastened and sandwiched between the journal walls 7 and the bridge 17, any localized axial thermal strain or displacement of the bearing caps 11 arising from the difference between the coefficients of thermal expansion of the journal walls 7 and the bearing caps 11 is greatly reduced as the journal walls 7 and the bridge 17 tend to expand to the same extent. Therefore, the frictional resistance to rotation of the crankshaft Sc is not increased. The clearance between the sleeve bearings 25 and the crankshaft Sc is also not increased, and no seizure takes place between the sleeve bearings 25 and the crankshaft Sc. Consequently, the cylinder block B is prevented from being unduly deformed.

FIGS. 3 through 10 illustrate an in-line four-cylinder water-cooled internal combustion engine incorporating therein a crankshaft supporting structure according to another embodiment of the present invention.

The internal combustion engine, generally denoted at E, comprises a cylinder block B and a cylinder head H mounted thereon with a gasket G interposed therebetween.

Figure 3:
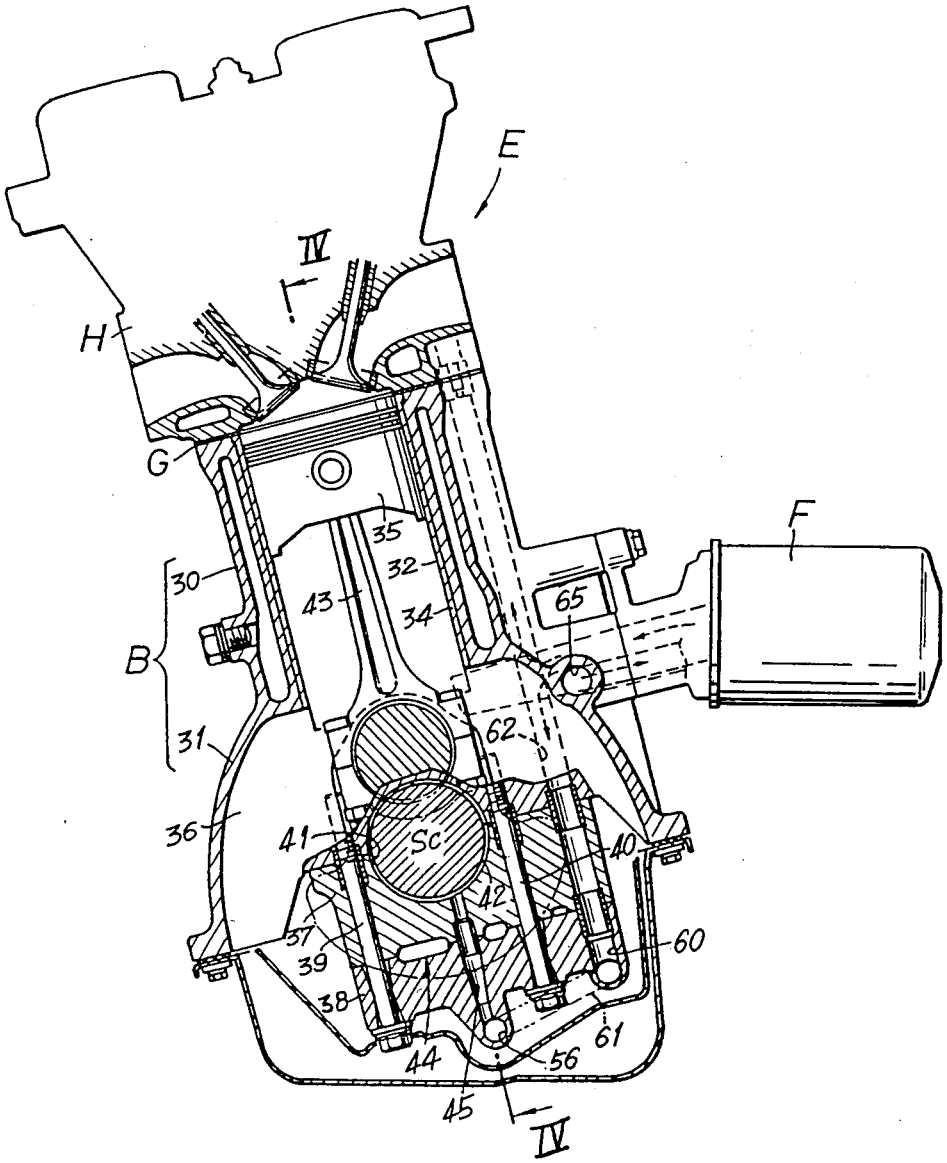
FIG. 3 is a vertical cross-sectional view of an internal combustion engine incorporating a crankshaft supporting structure according to another embodiment of the present invention.
Figure 4:
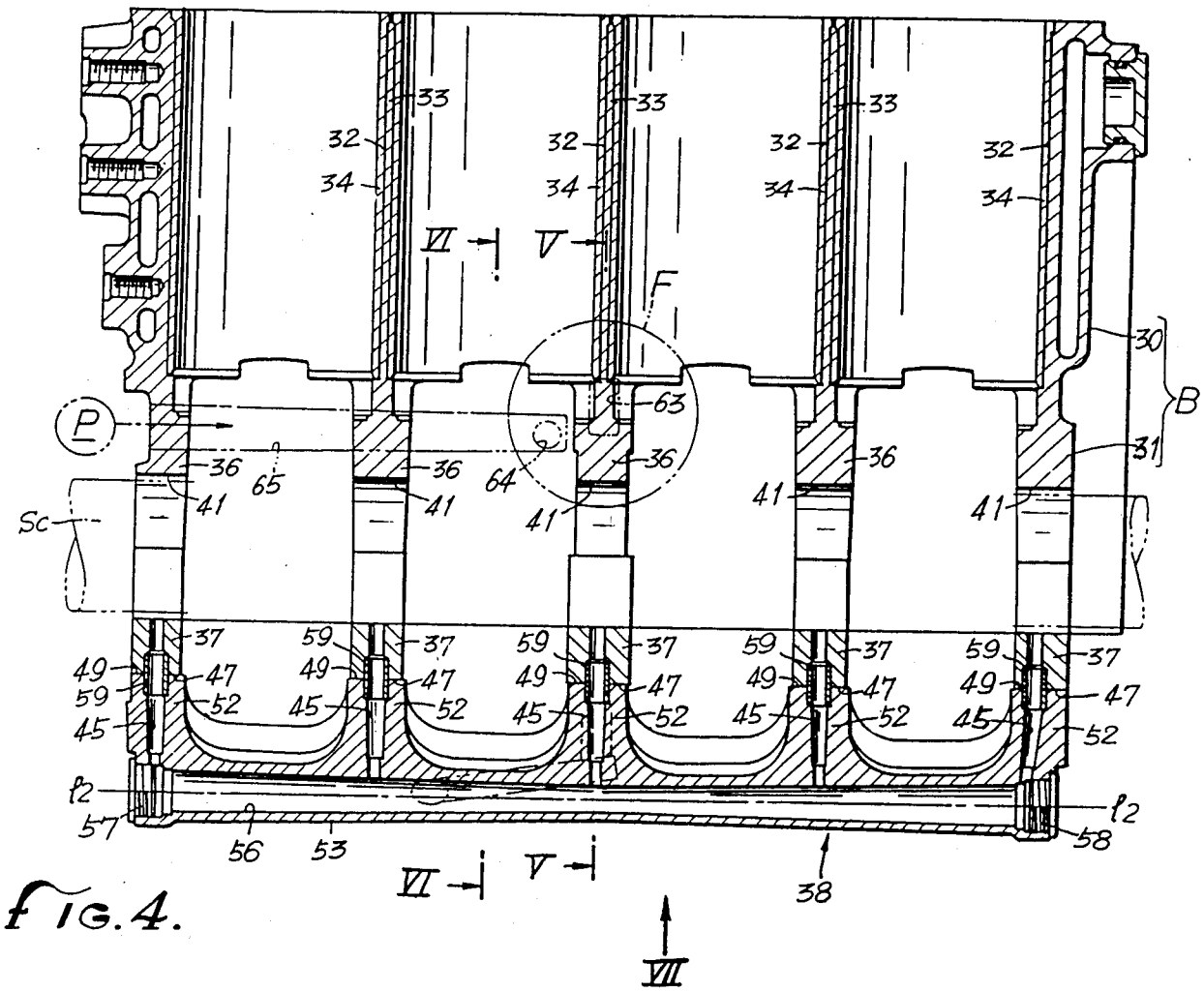
FIG. 4 is a cross-sectional view taken along line IV—IV of FIG. 3.
Figure 5:
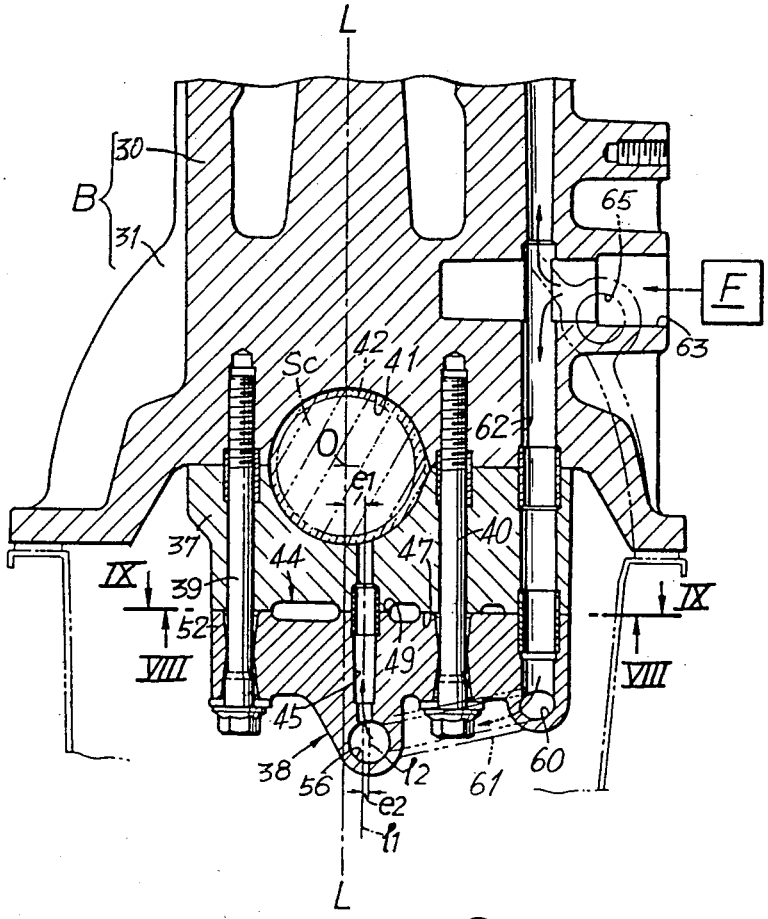
FIG. 5 is a cross-sectional view taken along line V—V of FIG. 4.

As shown in FIGS. 3 through 5, the cylinder block G is made of an alluminum alloy and includes a cylinder housing 30 and a crankcase 31. The cylinder housing 30 has four cyilnder bores 32 arranged in line in the so-called Siamese configuration with no water jackets in boundary walls 33 between the adjacent cylinder bores 32.

Cylinder liners 34 are fitted respectively in the cylinder bores 32, and pistons 35 are slidably fitted in the cylinder liners 34.

The crankcase 31 includes a plurality of integral journal walls 36 spaced at intervals along the array of the cylinder bores 32.

Bearing caps 37 of an iron alloy are held respectively against the lower surfaces of the journal walls 36. The bearing caps 37 are interconnected by a bridge 38 of an aluminum alloy extending across and held against the lower surfaces of the bearing caps 37. Each of the bearing caps 37 and the bridge 38 are firmly coupled by a pair of connecting bolts 39, 40 to the corresponding journal wall 36. The journal walls 36 and the bearing caps 37 fastened thereto jointly define bearing holes 41 between the bolts 39, 40. A crankshaft Sc is rotatably supported by sleeve bearings 42 in the bearing holes 41. The crankshaft Sc is coupled to the pistons 35 by means of connecting rods 43.

Figure 6:
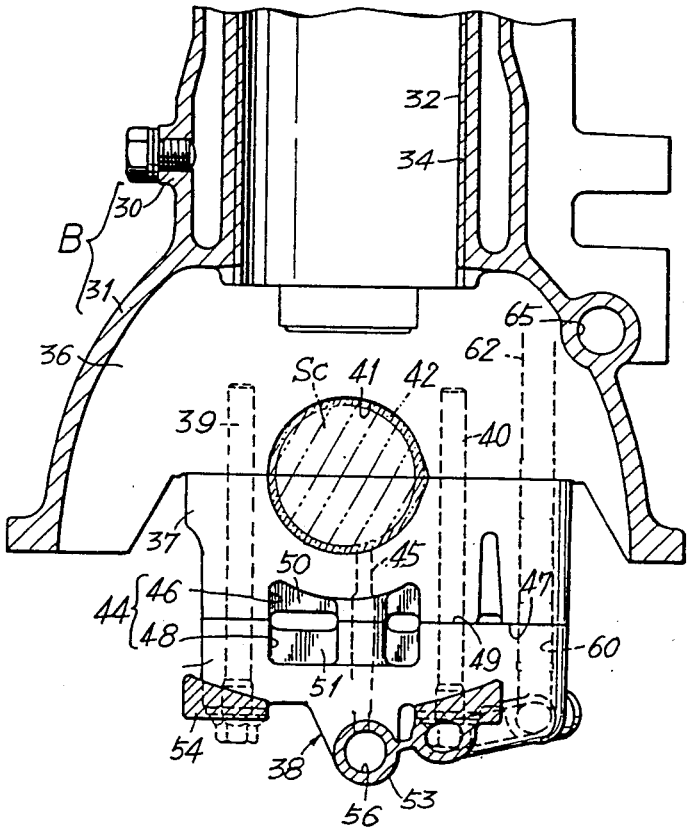
FIG. 6 is a cross-sectional view taken along line VI—VI of FIG. 4.
Figure 9:
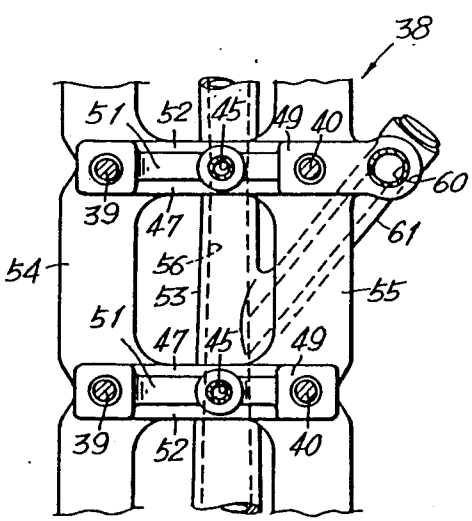
FIG. 9 is a fragmentary plan view of the brige, taken along line IX—IX of FIG. 5.
Figure 8:
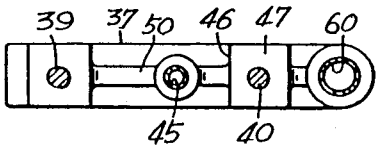
FIG. 8 is a bottom view of a bearing cap, taken along line VIII—VIII of FIG. 5.

As illustrated in FIGS. 6, 8 and 9, the bearing caps 37 and the bridge 38 jointly define cavities 44 therebetween positioned between the connecting bolts 39, 40 and including branch lubricating oil pasages 45. Each of the cavities 44 includes an upper recess 46 defined in the lower surface 47 (FIG. 8) of one of the bearing caps 37 and a lower recess 48 defined in the upper surface 49 (FIG. 9) of the bridge 38. The bearing caps 37 and the bridge 38 are reinforced by reinforcing ribs 50, 51 extending centrally across the recesses 46, 48, respectively, the branch lubricating oil passages 45 extending through the reinforcing ribs 50, 51. The cavities 44 are effective in reducing the weight of the bearing caps 37 and the bridge 38 without lowering their rigidity.

Figure 7:
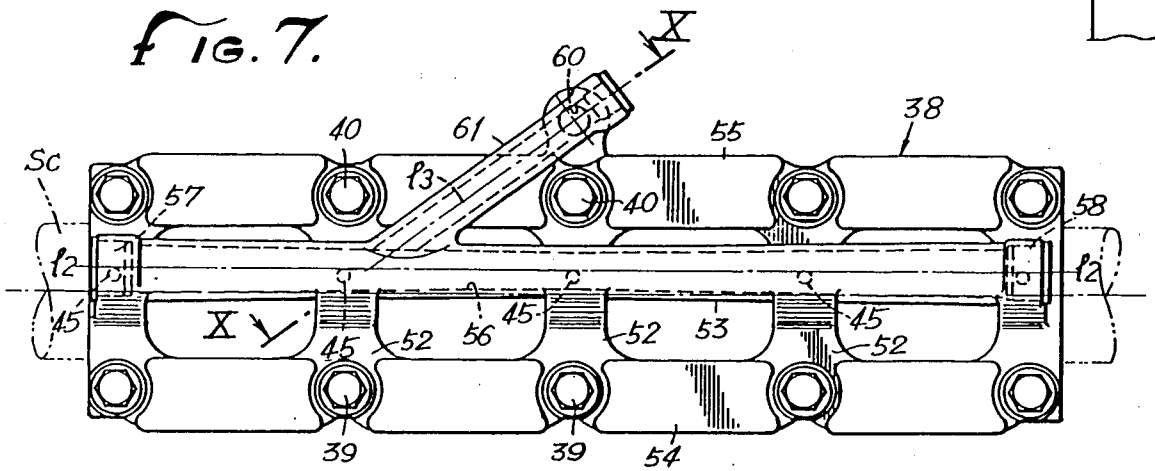
FIG. 7 is a bottom view of a bridge as seen in the direction of the arrow VII of FIG. 4.

As shown in FIG. 7, the bridge 38 is of a gridlike shape including a plurality of legs 52 spaced at intervals and coupled to the bearing caps 37, respectively, a central main portion 53 extending along the crankshaft Sc and interconnecting the legs 52 across their centers, and a pair of spaced outer portions 54, 55 extending parallel to the central main portion 53 and interconnecting the legs 52 across their ends. The central main portion 53 defines a main gallery 56 extending longitudinally therethrough and closed off at opposite ends thereof by blind plugs 57, 58, respectively. The branch oil passages 45 have lower ends communicating with the main gallery 56 and upper ends communicating with the bearing holes 41, respectively. In the branch oil passages 45, there are positioned knock pins 59 defining oil passages therethrough and located across the upper and lower surfaces 47, 49 of the bearing caps 37 and the bridge 38.

As shown in FIG. 5, each of the branch oil passages 45 has a longitudinal central axis $l_1$ displaced transversely a distance $e_1$ (to the right in FIG. 5) from the cylinder axis L passing through the center O of the crankshaft Sc. The main gallery 56 has a longitudinal central axis $l_2$ displaced transversely a distance $e_2$ (further to the right in FIG. 5) from the longitudinal central axis $l_1$ of the branch oil passages 45.

Figure 10:
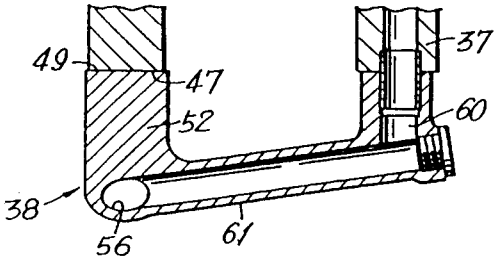
FIG. 10 is a fragmentary cross-sectional view taken along line X—X of FIG. 7.

As illustrated in FIGS. 5, 7 and 10, an oil supply passage 60 is defined through one of the bearing caps 37 and the bridge 38 on its side (righthand side in FIG. 5) toward which the main gallery 56 is displaced. The oil supply passage 60 has a lower end connected through an oil conduit 61 to the main gallery 56 at an intermediate position thereof. As shown in FIGS. 5 and 7, the oil conduit 61 is integrally formed with the bridge 38 on its side toward which the main gallery 56 is displaced. The oil conduit 61 is inclined with respect to the main gallery 56 and has an inner end communicating therewith between two adjacent branch oil passages 45. The oil conduit 61 has a longitudinal central axis $l_3$ which does not cross the central axis $l_1$ of any of the branch oil passages 45. Therefore, the dynamic pressure of the lubricating oil flowing from the oil supply passage 60 through the oil conduit 61 into the main gallery 56 does not act directly on any of the branch oil passages 45.

In FIGS. 4 and 5, the oil supply passage 60 has an upper end communicating with a vertical oil passage 62 defined in the cylinder block B. The oil passage 62 communicates with the outlet 63 of an oil filter F which has an inlet 64 communicating with an oil pump P through a horizontal oil passage 65 defined in the cylinder block B.

Operation of the internal combustion engine E is as follows: When the internal combustion engine E is operated, the explosion pressure acting on the pistons 35 is imposed on the crankshaft Sc. Since the crankshaft Sc is securely supported by the bearing caps 37 fastened by the bridge 38 to the journal walls 36, the crankshaft Sc is prevented from being subject to large bending and twisting stresses tending to deform the crankshaft Sc. The weights of the bearing caps 37 and the bridge 38 are reduced by the cavities 44 defined therebetween, but the bearing caps 37 and the bridge 38 are of sufficient mechanical strength because of the reinforcing ribs 50, 51. The cavities 44 are also effective in absorbing an axial thermal strain or displacement of the bearing caps 37 which arises from the difference between the coefficients of thermal expansion of the bearing caps 37 and the bridge 38. The cavities 44 are additionally effective to radiate heat from the bearing caps 37 and the bridge 38 for thereby suppressing any thermal deformation of the crankshaft supporting assembly and hence for reducing thermal stresses on the crankshaft Sc.

The lubricating oil supplied under pressure from the oil pump P flows through the oil passage 65 into the oil filter F. After being filtered by the oil filter F, the lubricating oil flows through the oil passage 62, the oil passage 60, the oil conduit 61 into the main gallery 56, from which the oil is supplied via the branch oil passages 45 to the sleeve bearings 42 around the crankshaft Sc. Since the central axis $l_3$ of the oil conduit 61 does not cross the central axis $l_1$ of any of the branch oil passages 45, the dynamic pressure of the lubricating oil flowing from the oil supply passage 60 through the oil conduit 61 into the main gallery 56 does not act directly on any of the branch oil passages 45. Therefore, the lubricating oil can be uniformly supplied under uniform pressure to the branch oil passages 45. The branch oil passages 45 and the main gallery 56 are displaced latearlly to the same side from the cylinder axis L passing through the center O of the crankshaft Sc. Accordingly, the entire length of the oil conduit 61 connected to the main gallery 56 can be reduced for allowing the lubricating oil from the oil pump P to be supplied to the branch oil passages 45 without a large time lag. The crankshaft Sc can therefore be efficiently lubricated. Inasmuch as the branch oil passages 45 are displaced from the cylinder axis L passing through the center O of the crankshaft Sc, the branch oil passages 45 are located off the position in which the crankshaft shaft Sc is subject to the maximum explosion pressure. With this arrangement, the rigidity of the bearing caps 37 is not reduced by the presence of the branch oil passages 45 therein.

The grid-shaped bridge 38 of an aluminum alloy is very lightweight for thereby reducing the overall weight of the engine E. The central main portion 53 with the main gallery 56 defined therethrough is very rigid to increase the rigidity of the entire bridge 38. The crankshaft supporting structure is of a required degree of rigidity even with the oil passages defined in the bearing caps 37 and the bridge 38.

Although certain preferred embodiments have been shown and described, it should be understood that many changes and modifications may be made therein without departing from the scope of the appended claims.

We claim:

1. A crankshaft support structure for a multicylinder engine, comprising, a cylinder block of a lightweight material having a first coefficient of thermal expansion, said cylinder block extending longitudinally along the crankshaft and having a plurality of lateral extending and longitudinally spaced journal walls, a plurality of bearing caps of heavyweight material having a second coefficient of thermal expansion different from said first coefficient, a bearing cap mounted on each journal wall, said bearing caps and journal walls defining bearing holes therebetween for supporting the crankshaft, a bridge of a lightweight material having a coefficient of thermal expansion which is substantially equal to said first coefficient, said bridge extending longitudinally over said plurality of bearing caps, and means mounting said bridge and bearing caps on said journal walls whereby said cylinder block and bridge undergo a substantially equal amount of thermal expansion and said bearing caps undergo a different amount of thermal expansion which is accommodated by said cylinder block and bridge, wherein said bridge includes a central main portion extending across said bearing caps along said crankshaft and a plurality of legs integral with said main portion and held against said bearing caps, respectively, and wherein said main portion defines a main gallery extending longitudinally therethrough, said legs and said bearing caps defining a plurality of branch oil passages therethrough, said branch oil passages communicating with said main gallery and said bearing holes.

2. The structure of claim 1 wherein said bearing caps are relatively longitudinally narrow for allowing unrestricted longitudinal thermal expansion of said block and bridge.

3. The structure of claim 2 wherein said bearing caps are relatively laterally wide for enhancing the strength of the bearing caps for supporting the crankshaft.

4. A crankshaft supporting structure in a multicylinder internal combustion engine, comprising:

a cylinder block made of a light alloy and including a cylinder housing defining a plurality of cylinder bores and a crankcase having a plurality of spaced journal walls;

a plurality of spaced bearing caps made of an iron alloy coupled respectively to said journal walls, said journal walls and said bearing caps jointly defining bearing holes therebetween;

a crankshaft rotatably supported in said bearing holes; and a bridge made of a light alloy and extending across said bearing caps and coupled to the bearing caps, wherein said bridge includes a central main portion extending across said bearing caps along said crankshaft and a plurality of legs integral with said main portion and held against said bearing caps, respectively, and wherein said main portion defines a main gallery extending longitudinally therethrough, said legs and said bearing caps defining a plurality of branch oil passages therethrough, said branch oil passages communicating with said main gallery and said bearing holes.

5. A crankshaft supporting structure according to claim 4, wherein said bridge includes a pair of spaced outer portions extending parallel to said main portion across the outer ends of said legs and interconnecting said legs.

6. A crankshaft supporting structure according to claim 4, wherein each of said branch oil passage has a longitudinal central axis displaced transversely to one side from the central axis of said cylinder housing passing through the center of said crankshaft.

7. A crankshaft supporting structure according to claim 6, wherein said main gallery has a longitudinal central axis displaced transversely to said one side from said central axis of said cylinder housing.

8. A crankshaft supporting structure according to claim 4, wherein said bridge has an oil conduit extending obliquely with respect to said main gallery, said oil conduit has an inner end communicating with said main gallery, said oil conduit having a longitudinal axis extending out of alignment with the central axis of any of said branch oil passages.

9. A crankshaft supporting structure according to claim 8, wherein said cylinder block, one of said bearing caps, and said bridge define oil passages communicating with the outer end of said oil conduit, further including an oil filter mounted on said cylinder block and having an outlet communicating with the oil passage defined in said cylinder block.

10. A crankshaft supporting structure according to claim 4, wherein said bearing caps and said legs jointly define cavities therebetween and have reinforcing ribs disposed in said cavities, respectively.

11. A crankshaft supporting structure according to claim 10, wherein each of said cavities has an upper recess defined in a lower surface of one of said bearing caps and a lower recess defined in an upper surface of one of said legs.

12. A crankshaft supporting structure according to claim 4, including a pair of connecting bolts extending through said bridge and each of said bearing caps threadedly into said journal walls to fasten said bridge and said bearing caps to said journal walls.

13. A crankshaft supporting structure according to claim 12, wherein said crankshaft is positioned and rotatably supported between said bearing caps and said journal walls.

14. A crankshaft supporting structure according to claim 12, including a pair of other connecting bolts extending through each of said bearing caps threadedly into said journal walls to fasten said bearing caps to said journal walls.

* * * * *